US007914964B2

(12) United States Patent
Yamazaki et al.

(10) Patent No.: US 7,914,964 B2
(45) Date of Patent: Mar. 29, 2011

(54) BOTH-SIDED IMAGE FORMING METHOD

(75) Inventors: Hiroshi Yamazaki, Hachioji (JP); Ken Ohmura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 910 days.

(21) Appl. No.: 11/780,812

(22) Filed: Jul. 20, 2007

(65) Prior Publication Data

US 2008/0050138 A1 Feb. 28, 2008

(30) Foreign Application Priority Data

Aug. 8, 2006 (JP) ..... 2006-215415

(51) Int. Cl.
*G03G 5/00* (2006.01)

(52) U.S. Cl. ..... 430/124.3; 430/124.31; 430/111.35; 430/111.4; 430/123.54; 430/45.1; 399/69; 399/309

(58) Field of Classification Search ..... 430/124.3, 430/124.31, 111.35, 111.4, 123.54, 45.1; 399/69, 309

See application file for complete search history.

(56) References Cited

U.S. PATENT DOCUMENTS 6,137,977 A * 10/2000 Okado et al. ..... 399/252
7,003,251 B2 * 2/2006 Suzuki et al. ..... 399/309
7,344,816 B2 * 3/2008 Matsumura et al. ..... 430/124.31
7,763,407 B2 * 7/2010 Behnke et al. ..... 430/124.2
2002/0141791 A1 * 10/2002 Rohde et al. ..... 399/306
2008/0038654 A1 * 2/2008 Yamazaki et al. ..... 430/110.3

FOREIGN PATENT DOCUMENTS

JP 2001201893 7/2001
JP 2002-214913 7/2002
JP 2005-338260 12/2005

OTHER PUBLICATIONS

Japanese Office Action dated Oct. 19, 2010 and English language translation thereof.

* cited by examiner

*Primary Examiner* — Mark A Chapman
(74) *Attorney, Agent, or Firm* — Lucas & Mercanti, LLP

(57) ABSTRACT

An image forming method of forming images on both sides of a recording sheet; comprising the steps of: fixing a first toner image on a first surface a recording sheet; and fixing a second toner image on a second surface of the recording sheet; wherein in two-component developer includes toner particles each containing a binder resin having a glass transition temperature Tg° C. and a colorant and carrier particles in each on which magnetic powder is dispersed in a binder resin including a phenol formaldehyde obtained by a polymerization process, and the first toner image is fixed with first heat in such a way that the surface temperature of the first surface of the recording sheet is a temperature in a range of Tg° C. or more and lower than 100° C.

15 Claims, 1 Drawing Sheet

BOTH-SIDED IMAGE FORMING METHOD

This application is based on Japanese Patent Application No. 2006-215415 filed on Aug. 8, 2006, in Japanese Patent Office, the entire content of which is hereby incorporated by reference.

BACKGROUND OF THE INVENTION

The present invention relates to a both-sided image forming method of an electro photographic system by which two-component developer including resin distribution type carrier of a phenol-formaldehyde resin is used.

Recently, in the electro photographic system image forming method, by using so called electronic RDH (Recirculating Document Handler), electronically both-side printing is conducted. The both-side printing by this electronic RDH is different from the system by which the both-side printing is conducted by the conventional analogue copier, the print printed on one surface of a recording sheet (an image formation substrate) is not stacked in an intermediate tray, and can continuously print directly on the other surface of the recording sheet. That is, based on the image signal converted into the digital signal, the first electrostatic latent image is formed on the electrostatic latent image carrier, and based on this electronic latent image, the toner image is formed, and after this toner image is transferred onto one surface of the recording sheet and fixing processing is conducted, the recording sheet is not stacked in an intermediate tray, when the toner image formed based on the second electrostatic latent image formed on the electrostatic latent image carrier is directly transferred onto the other surface of this recording sheet and fixing processed, the both-side printing is conducted.

In the both-sided surface image forming method by using this electronic RDH, when the fixing processing is conducted by the heating system, the high temperature recording sheet holding the heat by the fixing processing circulates in the device, and the temperature in the device rises by the result that the recording sheet itself is effected by the influence of the holding heat.

On the on hand, as the carrier in two-component developer, the resin distribution type carrier in which in the phenol-formaldehyde resin, the magnetic fine powder is distributed is light weight, further because hardness is high, it is usable as the carrier having the high durability (for example, refer to the Japanese Patent O.P.I. Publication (Tokkai) No. 2001-201893.). Because such a carrier is manufactured by the polymerization method, the shape close to the true ball or the uniformity of the surface is obtained, and the high electrostatic holding property is obtained. Further, in the phenol-formaldehyde resin forming the carrier, monomer component (formaldehyde) remains, and this monomer component is the low molecular weight, and has the polar group, and when this monomer component exists, the high electrostatic charge giving property of the carrier to the toner can be obtained.

However, when two-component developer using the carrier including the phenol-formaldehyde resin is applied to the both-sided surface image forming method by the electronic RDH, although the carrier itself has no generation of surface contamination, there is a problem that the image density is lowered or the toner scattering is generated.

SUMMARY

The present invention is conceived based on the above-described circumstance, the object of the present invention is to provide a both-sided surface image forming method by which even in the case where the visual image is formed by the thermal fixing on each of both surfaces of the recording sheet by using the electronic RDH, in the obtained image, enough image density is obtained, and the toner scattering does not generate, and stably good visual image can be obtained.

The present inventors found the fact that, as the result of eager consideration, by the conveyance of the recording sheet holding the heat, the heat is accumulated in the device and the temperature in the device rises, hereby, the water absorbed by the phenol-formaldehyde resin constituting the carrier is evaporated and the water content is varied in the carrier, specifically, lowered, or a monomer component of the phenol-formaldehyde resin is evaporated, resulting in that a charge providing capability of a carrier is lowered and also a charge providing capability of a two-component developer is lowered, as the result, the phenomena of the lowering of the image density or the toner scattering is generated, and arrive at the conception of the present invention.

The above object can be attained by the following image forming method on which one aspect of the present invention is reflected.

An image forming method of forming images on both sides of a recording sheet; comprises the steps of:

(1) forming a first electrostatic latent image on an image carrying member, developing the first electrostatic latent image with a two-component developer so as to form a first toner image on the image carrying member, transferring the first toner image from the image carrying member to a first surface of a recording sheet at a transfer section, and fixing the first toner image on the first surface of the recording sheet with heat at a fixing section;

(2) returning the recording sheet bearing the fixed toner image on the first surface from the fixing section to the transfer section;

(3) forming a second electrostatic latent image on the image carrying, developing the second electrostatic latent image with the two-component developer so as to form a second toner image on the image carrying member, transferring the second toner image from the image carrying member to a second surface of the recording sheet at the transfer section, and fixing the second toner image on the second surface of the recording sheet with heat at the fixing section;

wherein the two-component developer includes toner particles each containing a binder resin having a glass transition temperature Tg° C. and a colorant and carrier particles in each of which magnetic fine powder is dispersed in a binder resin including a polymerized phenol formaldehyde, and the first toner image is fixed with the heat in such a way that the surface temperature of the first surface of the recording sheet is a temperature in a range of Tg° C. or more and lower than 100° C.

DETAILED DESCRIPTION OF THE PREFERRED EMBODIMENT

Hereinafter, preferable embodiments of the present invention will be explained, however, the present invention is not limited to these preferable embodiments.

Firstly, preferable both-sided image forming methods to attain the above objects are explained.

In an image forming method, a toner image is formed on an electrostatic latent image carrying member with a two-component developer including at least a toner containing a binder resin and a colorant and a carrier in which a magnetic fine powder is dispersed in a binder resin including a phenol formaldehyde obtained by a polymerization process, the toner image is transferred onto one surface of a recording sheet, then a heat fixing process is conducted for the toner image with regard to the one surface of the recording sheet, thereafter, a toner image is formed on the electrostatic latent image carrying member with the two-component developer, the toner image is transferred onto the other surface of the recording sheet, then a heat fixing process is conducted for the toner image with regard to the other surface of the recording sheet, the both-sided image forming method is characterized in that at least the heat fixing process with regard to the one surface of the recording sheet is conducted on a condition that a surface temperature of the one surface of the recording sheet is the temperature (Tg) of a glass transition point of the binder resin contained in the toner or more and less than 100° C.

According to the both-sided image forming method of the present invention, even when the carrier used in the structure in which on the both surfaces of the recording sheet, the printing by the thermal fixing is conducted, is the carrier in which the phenol-formaldehyde resin is used, because the thermal fixing processing is conducted in the specific thermal fixing condition, the temperature rise in the device can be suppressed, hereby, the variation of the electrostatic charge property is also suppressed, as the result, in the obtained visual image, a sufficient image density is obtained, and the toner scattering is not generated, as the result, stably good visual image can be formed.

The both-sided image forming method of the present invention will be described in detail below.

The both-sided image forming method of the present invention is a method by which the visual image is formed on each of both surfaces of the recording sheet by using a specific two-component developer by the electronic RDH.

The both-sided image forming device preferably used in the both-sided image forming method of the present invention will be described below.

Figure 1:
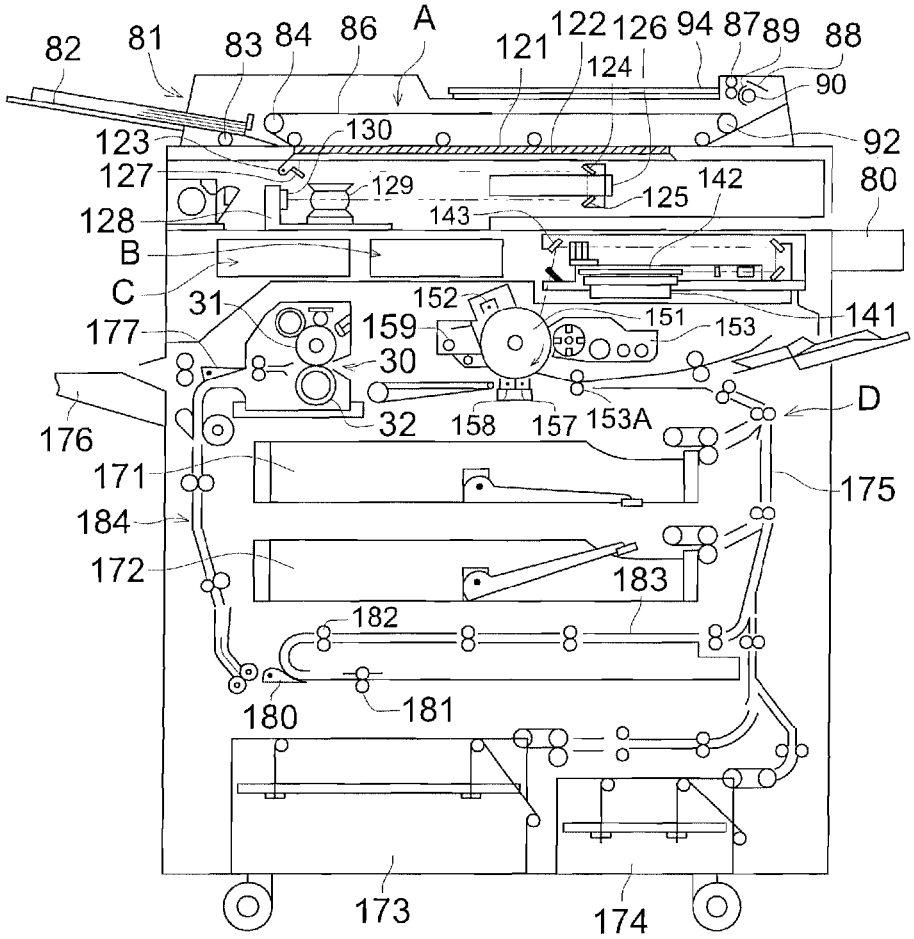
FIG. 1 is a schematic view to explain a whole structure of a both-sided image forming apparatus suitably usable in the present invention.

FIG. 1 is a view showing the overall structure of the both-sided image forming device which can be preferably used for the both-sided image forming method of the present invention.

This both-sided image forming device is a digital copier by which the visual image is formed on the both surfaces of the recording sheet by using the electronic RDH, and is structured by an image reading part A, image processing part B, image memory part C, image forming part D.

In the image reading part A, on the document 121 placed on the platen glass 122, light is irradiated on the document 121 by the halogen light source 123 provided on a carriage (not shown) moving on the guide rail, the reflection light from this document 121, that is, the optical image corresponding to the image on the document 121 is guided to the reading unit 128 through the movable mirror unit 126 having a pair of mirrors 124, 125 which moves on the mirror 127 provided on the carriage together with the halogen light source 123 and the guide rail. This lens reading unit 128 is structured by the image focusing lens 129 and CCD line sensor 130, and the optical image guided into this lens reading unit 128 is converged by the image focusing lens 129, and image focused on the light receiving surface of the CCD line sensor 130, and the optical image on the line is successively photoelectric converted into the electric signal by the CCD line sensor 130.

Specifically, by the motor (not shown), the halogen light source 123, and mirror 127, and movable mirror unit 126 are interlocked and driven, the image information of the document for one page is read in the CCD line sensor 130 as the image data, and the image data of the document 121 read by this image reading part A is, after each kind of image processing such as the density conversion, filter processing, magnification processing, γ correction, is conducted, stored in the image memory part C.

Numeral 81 is an automatic document feeding device by which the reading document 121 is automatically conveyed on the platen glass 122, when a plurality of reading documents 121 are overlapped and set on the document set table 82, and a copy button of the operation panel 80 is pressed, each page of this document 121 is taken out by one by one sheet by the sheet feed roller 83, the document is successively automatically conveyed to a predetermined position on the platen glass 122 by the belt 86 circulating moved by the drive roller 84, driven roller 92, and the page whose reading is completed s removed from the platen glass 122, and delivered on the document s removed from the platen glass 122, and delivered on the document s removed from the platen glass 122, and delivered on the document delivery tray 94 through the document delivery roller 87.

In this automatic document feeding device 81, both-sides of one sheet of the both-sided document can be automatically read. That is, the both-sided document is automatically conveyed on the platen glass 122, and after the image data of its single surface is read, under the condition that the both-sided document is reversely rotated by the reverse mechanism having the guide plate 89, reversing roller 90, and switching guide 88 driven by the solenoid, not shown, the direction is switched, and automatically conveyed again to a predetermined position of the platen glass 122, and the image data of the rear surface of the document can be read.

In the image forming part D, corresponding to the image data outputted through the image memory part C, the visual image is formed on the recording sheet.

That is, in the image forming part D, the laser beam generated by the semiconductor laser (not shown) is modulated based on the image data, this modulated laser beam is rotation scanned by the polygonal mirror 142 rotated by the drive motor 141, through fθ lens (not shown) and the reflection mirror 143, the conductive layer and the light conductor layer formed of organic electrostatic latent image carrier (OPC) are formed on the outer peripheral surface of the cylindrical base body, and irradiated on the surface of the electrostatic latent image carrier 151 rotated clockwise by the moving power from the drive source, not shown, for example, the electrostatic latent image is formed by the image exposure on the electrostatic latent image carrier 151 previously uniformly charged by the charger 152 formed of, for example, scorotron charger, the toner image is formed by conveying the toner on the surface of the electrostatic latent image carrier 151 by the rotating developing sleeve 153A of the developer 153, this toner image is transferred onto the recording sheet conveyed in timed relationship by the transfer pole 157, separated from the electrostatic latent image carrier 151 by the separation pole 158, and fixed by the fixing device 30, hereby, the visual image is formed. Hereupon, the developing unit 153 may also be any developing system of contact system and non contact system. Further, in FIG. 1, numeral 159 is a cleaning device.

In the both-sided image forming device by the electronic RDH by which the both-sided image formation is conducted as described above, the both-sided image formation is conducted as follows.

That is, when the copy button provided on the operation panel 80 is pressed, initially the both-sided image data of the document 121 is obtained by the image reading part A as described above, the corresponding cassettes 171-174 according to the indication of the size from the cassette 171-174 stocked for each size are selected, the recording sheet is taken out from the cassettes 171-174, by the recording sheet conveying mechanism 175 structured by having a plurality of conveying rollers and conveying belt, fed to the image forming part D and the image forming operation is conducted, and the toner image corresponding to the image data of the surface of the document is formed on the one surface of the recording sheet, and thermal fixing processing according to the one surface of the recording sheet is conducted in the fixing device 30, and the visual image is formed.

Next, in the case where the recording sheet on whose one surface the visual image is formed, is delivered from the fixing device 30, when the first switching claw 177 is extended in the right upper direction, and the inlet of the both-sided surface copy sheet conveyance path 184 is made into open condition, the recording sheet is conveyed downward, the second switching claw 180 of the both-sided surface copy sheet conveyance path 184 is extended left lower direction, and the exit of the both-sided surface copy sheet conveyance path 184 is made into open condition and is conveyed to the reverse roller 181, when this reverse roller 181 is reversely rotated, together with this, the second switching claw 180 is extended in left upper direction and the exit of the both-sided surface copy sheet conveyance path 184 is made into closed condition, hereby, the recording sheet is fed to the image forming part D by the recording sheet conveyance mechanism 175 via the reverse conveyance path 183 under the condition that the surface and the rear of the recording sheet are reversed, in the same manner as the cassettes 171-174, and the image forming operation as described above is conducted and the toner image corresponding to the image data of the rear surface of the document is formed on the other surface of the recording sheet, and in the fixing device 30, the thermal fixing processing according to the other surface of the recording sheet is conducted and the visual image is formed.

Then, the first switching claw 177 is extended in the right lower direction, and when the inlet of the both-sided surface copy sheet conveyance path 184 is made into closed condition, the recording sheet on whose both-sided surfaces images are formed is delivered outside the device from the recording sheet delivery tray 176.

[Fixing Device]

Figure 2:
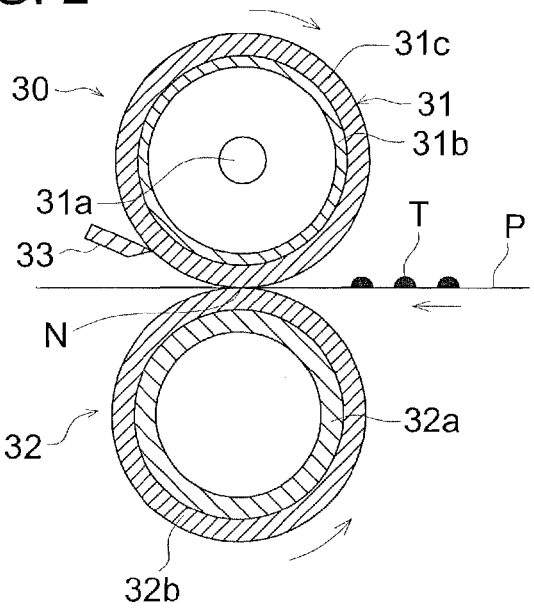
FIG. 2 is a cross sectional view showing a structure of a fixing device used in the both-sided image forming apparatus shown in FIG. 1.

FIG. 2 is a sectional view for explaining showing an example of the structure of the fixing device of the both-sided image forming method shown in FIG. 1.

This fixing device 30 is the device in which the surface of the core metal 31*b* formed of the cylindrical, for example, iron is sheathed by the sheathing layer 31*c* formed of, for example, PFA tube, and the heating roller 31 housing the heater 31*a* in the central part and the pressure roller 32 in which the surface of the core metal 32*a* formed of the cylindrical, for example, iron is covered by the cover layer 32*b* formed of, for example, sponge-like silicon rubber, are brought into contact by the total load of, for example, 150 N, the fixing nip part N is formed. Hereupon, in FIG. 2, sign T is the toner image formed on the recording sheet P, and numeral 33 is the separation claw.

In the both-sided image forming method of present invention, the thermal fixing condition according to one surface of at least recording sheet is the surface temperature in one surface of the recording sheet, specifically, the heating condition of the fixing device 30 is set so that the surface temperature in one surface of the recording sheet in an exhaust port from the fixing device 30, is not more than 100° C. more than the glass transition point temperature (Tg) of binder resin constituting the toner, preferably, the glass transition point temperature Tg plus 20° C. to 70° C. Further, the thermal fixing condition according to the other surface of the recording sheet is also preferable that it is the same as described above.

When the surface temperature on one surface of the recording sheet is more than the glass transition point temperature (Tg) of the binder resin included in the toner, the toner image can be securely fixed on one surface of the recording sheet P in the fixing device 30. On the one hand, when the surface temperature on one surface of the recording sheet is not more than 100° C., when the recording sheet on whose one surface printing is conducted, is conveyed in the device, the accumulation of the heat is suppressed, good electric charge giving property and electric charge holding property are obtained, as the result, the good image can be stably obtained.

When an example of the heating condition in the fixing device 30 is shown, for example, the fixing temperature (the surface temperature of the heating roller 31) is more than 100° C. not more than 150° C., the nip width of the fixing nip N formed of the heating roller 31 and the pressure roller 32 is 1-5 mm, preferably, 2-4 mm, further, the contact load of the heating roller 31 with the pressure roller 32 is 80-200 N, preferably, 110-170 N, further, the fixing line speed is 80-640 mm/sec.

According to the heating condition in which the surface temperature on one surface of the recording sheet is in the above range, the temperature in the developing unit 153 in which the carrier is housed can be securely controlled to not more than 100° C.

[Recording Sheet]

The recording sheet used in the both-sided image forming method of the present invention is the supporting body holding the toner image, specifically, each kind of the normal sheet from thin sheet to thick sheet, quality paper, coated printing paper such as the art paper or coat paper, Japanese paper or postcard paper, the plastic film for OHP, cloth can be listed, however, it is not limited to them.

[Two-Component Developer]

A developer used for the both-sided image forming method of the present invention is a two-component developer in which at least a toner which contains a binder resin and a colorant and a below-mentioned carrier are mixed.

[Toner]

As the toner constituting the two-component developer, specifically, more concretely, a capsule type toner made in a state where a colorant (coloring fine particles) and an internally added agent such as a releasing agent and a charge control agent added as required are contained in a binder resin may be preferable.

Moreover, this toner is desirable to be one which is constituted as a low-temperature fixable type toner.

Examples of the methods of manufacturing such a toner are not limited specifically and include a grinding method, a suspension-polymerization method, a mini emulsion polymerization condensation method, an emulsion-polymerization condensation method, a dissolution suspension method, a polyester molecule extending method and other well-known methods.

[Pulverizing Method]

The Pulverizing method is performed as follows. That is, a binder resin and a colorant are mixed sufficiently together with toner composition components such as a releasing agent and a charge control agent, if needed, by a mixer such as a HENSCHEL MIXER and a ball mill, then melted kneaded by a heating kneader such as a heating roller, a kneader and a extruder, subsequently cooled solidified and then pulverized classified, thereby obtaining toner particles.

[Suspension Polymerization Method]

The suspension polymerization method is performed as follows. That is, toner constituents, such as a releasing agent and a colorant and a radical polymerization initiator are added in a radical polymerizable monomer, and these are dissolved or dispersed in the radical polymerizable monomer with a sand grinder etc. so as to form a uniform monomer dispersion liquid, and subsequently the uniform monomer dispersion liquid is added in a water base medium in which a dispersion stabilizer was added beforehand, and the uniform monomer dispersion liquid is dispersed in the water base medium with a homomixer, a ultrasonic homogenization, etc., thereby forming oil droplets. Here, since the size of the oil droplets becomes finally a size of toner, the dispersion is controlled so as to obtain a desired size. The size of the dispersed oil droplets is preferably made to be a volume average median size of from 3 μm to 10 μm. Subsequently, a polymerization process is carried out with heating, and, coloring particles can be obtained by removing the dispersion stabilizer, by rinsing and drying after the polymerization reaction completes, and further toner particles can be obtained by adding and mixing an external additive agent as necessary.

[Binder Resin]

When toner particles constituting the toner are produced by the crushing method or the dissolving suspension method, as the binder resin for constituting the toner, various kinds of known resin, for example, polystyrene; polymers of styrene substituents such as a poly-p-chlorostyrene and a polyvinyl toluene; styrene copolymers such as a styrene-p-chlorostyrene copolymer, a styrene-vinyltoluene copolymer, a styrene-vinyl naphthalene copolymer, a styrene-acrylate ester copolymer, a styrene-methacrylate ester copolymer, a styrene-α-chloromethyl methacrylate copolymer, a styrene-acrylonitrile copolymer, a styrene-vinyl methyl ether copolymer, a styrene-vinyl ethyl ether copolymer, a styrene-vinyl methylketone copolymer, a styrene-butadiene copolymer, a styrene-isoprene copolymer, a styrene-acrylonitrile-indene copolymer; a polyvinyl chloride, a phenol resin, a natural modified phenol resin, a natural resin modified maleic resin, an acrylate resin, a methacrylic resin, polyvinyl acetate, a silicone resin, a polyester resin, a polyurethane resin, a polyamide resin, a furan resin, an epoxy resin, a xylene resin, a polyvinyl butyral resin, a terpene resin, a cumarone indene resin, petroleum-based resin may be usable. As a preferable binder, a partially- or entirely-crosslinked styrene resin may be employed. These resins can be used singly or in combination of two or more kinds of them.

When the toner particles are prepared by the suspension polymerization method, mini-emulsion polymerization-coagulation method or emulsion polymerization coagulation method, for example, the following can be used as the polymerizable monomer for forming the resin to obtain the resin for constituting the toner: A vinyl type monomer, for example, styrene or a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene p-n-nonylstyrene, p-n-decylstyrene and p-n-dodecylstyrene; a methacrylate derivative such as methyl methacrylate, ethyl methacrylate, n-butyl methacrylate, iso-propyl methacrylate, iso-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; an acrylate derivative such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate and phenyl acrylate; an olefin such as ethylene, propylene and iso-butylene, a vinyl halide such as vinyl chloride, vinylidene chloride, vinyl bromide, vinyl fluoride and vinylidene fluoride; a vinyl ester such as vinyl propionate, vinyl acetate and vinyl benzoate; a vinyl ether such as vinyl methyl ether and vinyl ethyl ether; a vinyl ketone such as vinyl methyl ketone, vinyl ethyl ketone and vinyl hexyl ketone; an N-vinyl compound such as N-vinylcarbazole, N-vinylindole and N-vinyl pyrrolidone; a vinyl compound such as vinylnaphthalene and vinylpyridine; and an acrylic acid or a methacrylic acid derivative such as acrylonitrile and acrylamide. These vinyl type monomers may be used singly or in combination of two or more kinds of them.

Moreover, a monomer having an ionic dissociable group is preferably used in combination with the above resin. The polymerizable monomer having an ionic dissociable group is one having a substituent such as a carboxyl group, a sulfonic acid group or a phosphoric group; concretely acrylic acid, methacrylic acid, maleic acid, itaconic acid, cinnamic acid, fumaric acid, a mono-alkyl maleate, a mono-alkyl itaconate, styrenesulfonic acid, allyl sulfosuccinate, 2-acrylamide-2-methylpropanesulfonic acid, acidphosphoxyethyl methacrylate and 3-chloro-2-acidphosphoxypropyl methacrylate are cited.

Furthermore, as a cross-linking agent, binder resins having crosslinked structure can be obtained by using a multifunctional vinyl compounds as the polymerizable monomer; concrete examples are divinylbenzene, ethylene glycol dimethacrylate, diethylene glycol diacrylate, diethylene glycol dimethacrylate, diethylene glycol diacrylate, triethylene glycol diacrylate, neopentyl glycol dimethacrylate and neopentyl glycol diacrylate. These crosslinking agents may be used solely or in combination of two or more.

As the binder resin included in the toner of two-component developer used for the full color image forming method of the present invention, from the view point of the fixing property, conservation property, the resin whose glass transition point temperature (Tg) is 50-75° C., particularly, 52-70° C., is preferable. Further, as the binder resin, in the molecular weight distribution by the styrene converted molecular weight measured by the Gelpermiation chromatography (GPC), it is preferable that it has a peak or shoulder in the range of 600-50,000, particularly, the peak or shoulder of the low molecular weight component is in the range of 3,000-15,000, further, a value of the ratio (Mw/Mn) of the weight average molecular weight (Mw) and the number average molecular weight (Mn) is 2-100.

Herein, the glass transition point (Tg) of the resin component is a value measured by DSC, the cross point of the base line and the inclination of heat absorption peak is the glass transition point. Specifically, by using the differential scan calorimeter, temperature rises to 100° C., after remains as it is for 3 minutes at the temperature, cools to the room temperature at the falling temperature 10° C./min. Next, when this sample is measured at the temperature rising speed 10° C./min, the cross point of the extended line of the base line less than the glass transition point, and the tangent line showing the maximum inclination between a range from the rising part of the peak to the apex of the peak, is shown as the glass transition point. Herein, as the measuring instrument, an instrument such as DSC-7 made by Parkin-elmer co. can be used.

Further, the measuring method of the molecular weight of the binder resin by GPC is as follows. That is, to a measuring sample 0.5-5 mg, for example, to 1 mg, tetrahydrofran (THF) 1 cc is added, by using magnetic staler, mixed and sufficiently dissolved in the room temperature, next, after processed by membrane filter of bore size 0.45-0.50 μm, filled in GPC column. The measurement of GPC is conducted when the column is stabilized to the temperature 40° C., THF is flowed at the flow rate of 1 cc/min, and the sample whose density is 1 mg/cc, is filled in by about 100 μl. It is preferable that the column is used in combination with polystyrene jell-column in the market. For example, the combination of Showa-denko co. made Shodex GPC KF-801, 802, 803, 804, 805, 806, 807, the combination of To-so co. made TSKge 1G1000H, G2000H, G3000H, G4000H, G5000H, G6000H, G7000H, TSK guard column, can be listed. As the detector, refractive index detector (IR detector), or UV detector can be used. The molecular weight of the sample is based on the molecular weight distribution, and calculates by using the weigh-in line made by using mono-dispersion polystyrene standard particle. As polystyrene for making the weigh-in line, it is allowable when about 10 points are used.

[Surfactant]

When the toner particle constituting the toner is prepared by the suspension polymerization method, mini-emulsion method or the emulsion polymerization, the surfactant usable for obtaining the binder resin is not specifically limited. Ionic surfactants, for example, a sulfonic acid salt such as sodium dodecylbenzenesulfonate and sodium aryl-alkyl polyether sulfonate, sulfuric acid ester salt such as sodium dodecylasulfate, sodium tetradecylsulfate, sodium pentadecylsulfate, sodium pentadecylsulfate and sodium octylsulfate, a fatty acid salt such as sodium oleate, sodium laurate, sodium caprate, sodium caprylate, sodium capronate, potassium stearate and calcium oleate can be cited as suitable examples. A nonionic surfactant such as polyethylene oxide, polypropylene oxide, a combination of polypropylene oxide and polyethylene oxide, an ester of polyethylene glycol and a higher fatty acid, an alkylphenol polyethylene oxide, an ester of higher fatty acid and polypropylene oxide and a sorbitan ester is also usable. These surfactants are used as an emulsifying agent when the toner is produced by the emulsion polymerization but they may be used for another process and another purpose.

[Dispersion Stabilizer]

In the case that toner particles constituting a toner are manufactured by a suspension polymerization method, a dispersion stabilizer composed of easily removable inorganic compounds also may be used. As the dispersion stabilizer, for example, tricalcium phosphate, magnesium hydroxide, hydrophilic colloidal silica, etc. may be listed up, and especially, tricalcium phosphate is desirable. Since this dispersion stabilizer is decomposed easily with an acid, such as hydrochloric acid, this dispersion stabilizer can be easily removable from the surface of toner particles.

[Polymerization Initiator]

In the case of the suspension polymerization, an oil soluble radical polymerization initiator can be used. Examples of oil-soluble polymerization initiator include an azo type or diazo type polymerization initiator such as 2,2'-azobis-(2,4-dimethylvaleronitrile), 2,2'-azobis-isobutylnitrile, 1,1'-azobis(cyclohexane-1-carbonitrile), 2,2'-azobis-4 methoxy-2,4-dimethylvaleronitrile and azobisisobutylonitrile, a peroxide type polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxicyclohexyl)propane and tris-(t-butyl peroxide), and a polymer initiator having a peroxide moiety at a side-chain thereof.

[Chain Transfer Agent]

In the case that toner particles constituting a toner are manufactured by a suspension polymerization method, a mini emulsion polymerization condensation method, or an emulsion polymerization condensation method, a chain transfer agent being generally used can be used for the purpose of adjusting the molecular weight of a binder resin.

The chain transfer agent is not particularly limited, and as the chain transfer agent, for example, mercaptan, such as octylmercaptan, dodecylmercaptan, tert-dodecylmercaptan; n-octyl-3-mercaptopropionic acid ester, terpinolene, carbon tetrabromide and α-methyl styrene dimer, may be employed.

[Colorant]

As a colorant constituting a toner, a well-known inorganic colorant or organic colorant may be used.

Concrete colorants are shown below.

As a black colorant, for example, carbon black such as furnace black, channel black, acetylene black, thermal black and lamp black; and magnetic powder such as magnetite and ferrite are employable.

Moreover, the image forming method according to the present invention may form a monochrome image, and also may form a color image.

As a colorant for magenta or red in the case of forming a color image, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C.I. pigment red 53:1, C.I. pigment red 57:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. pigment red 178, C.I. pigment red 222, etc. may be listed.

As a colorant for orange or yellow in the case of forming a color image, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 74, C. I. pigment yellow 93, the C.I. pigment yellow 94, the C.I. pigment yellow 138, etc. may be listed.

As a colorant for green or cyan in the case of forming a color image, C.I. pigment blue 15, the C.I. pigment blue 15:2, the C.I. pigment blue 15:3, the C.I. pigment blue 15:4, the C.I. pigment blue 16, the C.I. pigment blue 60, the C.I. pigment blue 62, the C.I. pigment blue 66, the C.I. pigment green 7, etc. may be listed.

The above colorants may be used solely or in a combination of two or more kinds.

Moreover, an added amount of the colorant may be made within a range of 1-30 weight %, preferably within a range of 2 to 20 weight % for the whole of a toner.

As the colorant, a colorant having been subjected to a surface modification also may be used. As the surface modifying agent, a conventionally well-known surface modifying agent may be used. More concretely, a silane coupling agent, a titanium coupling agent, and an aluminum coupling agent may be preferably employed.

[Electric Charge Control Agent]

Moreover, in toner particles constituting a toner, an electric charge control agent may be contained if needed. As the electric charge control agent, well-known various kinds of compounds may be used.

[Releasing Agent]

Moreover, in toner particles which constitute a toner, a releasing agent may be contained if needed. Examples of the releasing agent (or a mold lubricant, parting agent), include a paraffin wax, a microcrystalline wax, a Fisher-Tropsch wax, a polyolefin wax, a carnauba wax, and derivatives of these. Examples of derivatives include, an oxide, a block copolymer with a vinyl monomer, and a graft modified one. Moreover, a long chain alcohol, a long chain fatty acid, an acid amide, an ester wax, a ketone, a hardening castor oil and its derivative, a vegetable-based wax, an animal-based wax, a mineral-based wax, a petrolactam, etc. may be used.

[Particle Size of Toner Particles]

The particle size of toner particles may be desirably 3 to 8 μm as the volume average median size. This particle size may be controlled by the adjustment of the dispersion size of oil droplets when the toner particles are manufactured by a suspension polymerization method.

When the volume average median size is made within a range of 3 to 8 μm, the reproducibility of a micro line and the high image quality of a photographic image can be attained, in addition, the amount of consumption of toner can be reduced in comparison with the case where a relatively large size toner is used.

The volume average median size of toner particles can be measured by using a Coulter Multi-Sizer (manufactured by a coulter company) with an aperture of 50 μm and a particle size distribution in the range of 2.0 to 40 μm.

For the purpose of improving fluidity and chargeability, as well as of enhancing cleaning properties, so-called external additives added into such a toner can be used. These external additives are not particularly limited, but various kinds of fine inorganic and organic particles, as well as lubricant can be used. Further, various kinds of external additives may be used in combination.

A carrier constituting the two-component developer is a carrier (hereinafter, may be referred as "specific phenol resin dispersion type carrier" in which a magnetic-substance fine powder is dispersed in a binder resin including a phenol formaldehyde resin obtained by a polymerization process.

[Magnetic-Substance Fine Powder]

As the magnetic-substance fine powder constituting a specific resin dispersion type carrier, a fine powder which is composed of well-known magnetic materials, for example, a metal or a metal oxide such as iron, a ferrite represented by formula a): $MO.Fe_2O_3$, and a magnetite represented by formula b): $MFe_2O_4$, an alloy of these metals or metal oxides and a metal, such as aluminum and lead may be used. Here, in the formulas a) and b), M represents a metal of divalent or monovalent, for example, such as Mn, Fe, Ni, Co, Cu, Mg, Zn, Cd, and Li, and these are used solely, or in combination of two or more kinds.

As a concrete example of magnetic-substance fine powder, for example, a magnetite, a γ iron oxide, a Mn—Zn type ferrite, a Ni—Zn type ferrite, a Mn—Mg type ferrite, a Ca—Mg type ferrite, a Li type ferrite, a Cu—Zn type ferrite, etc. may be exemplified.

The content of the magnetic-substance fine powder in a specific resin dispersion type carrier is 40 to 99 weight %, preferably 50-70 weight %.

These magnetic-substance fine powder desirably has a number average primary size of 0.1 to 0.5 μm. The number average primary size is an arithmetic mean value obtained such that the diameter in the Ferre direction of 100 magnetic-substance fine powders are measured by using an electron microscope photograph magnified by 10,000 times and the arithmetic mean value is obtained from the measurements.

Moreover, for the purpose of the adjustment of magnetic property etc., a nonmagnetic metal oxide powder in which non-magnetic metals, such as Mg, aluminum, Si, Ca, Sc, Ti, V, Cr, Mn, Fe, Co, nickel, Cu, Zn, Sr, Y, Zr, Nb, Mo, Cd, Sn, Ba, and Pb is used solely or in combination of two or more kinds, may be used together with the above-mentioned magnetic-substance fine powder. As concrete examples of the nonmagnetic metal oxide powder, for example, $Al_2CO_3$, $SiO_2$, CaO and $TiO_2$, $V_2O_5$, $CrO_2$, $MnO_2$, $Fe_2O_3$, CoO, NiO, CuO, ZnO and SrO, $Y_2O_3$, $ZrO_2$ type, etc. may be listed up.

These nonmagnetic metal oxide powders are desirably a powder having a number average primary particle size of 0.1 to 1.0 μm.

The content of the nonmagnetic metal oxide powder in a specific resin dispersion type carrier is 10 to 60 weight %, preferably 20-40 weight %.

From a viewpoint of increasing lipophilicity and hydrophobicity, the surface of the magnetic-substance fine powder is subjected to a lipophilization process with a lipophilization processing agent, such as various coupling agents and higher fatty acids, and thereafter, the magnetic-substance fine powder may be used.

The added amount of the lipophilization processing agent is desirably 0.1 to 10 parts by mass for 100 parts by mass of the magnetic-substance fine powder, more preferably 0.2 to 6 parts by mass.

[Production Method of a Carrier]

Such a specific phenol resin dispersion type carrier may be manufactured, for example, by a method having been referred to as a polymerizing method.

By manufacturing the specific phenol resin dispersion type carrier by the polymerizing method, since a shape near a true ball is acquired for the carrier, carrier contamination can be suppressed, and since the surface uniformity is acquired, high charge providing ability can be obtained. In addition, the shape of the carrier can be controlled easily at the time of production.

Concretely, a specific phenol resin dispersion type carrier can be obtained such a raw material monomer such as a phenol and aldehyde and a magnetic-substance fine powder are added in a water base media containing a dispersion stabilizer, such as tricalcium phosphate, magnesium hydroxide and hydrophilicity silica in a colloid state, dissolved or dispersed in the water base media. And then, a polymerization process (addition condensation reaction) is conducted in the resultant solution under the existence of a basic catalyst.

[Basic Catalyst]

As the basic catalyst used in the case that the binder resin is a phenol formaldehyde resin or a melamine resin, for example, an aqua-ammonia, hexamethylenetetramine and alkylamine, such as dimethylamine, diethyl tri amine, polyethylene imine, etc., may be listed. These basic catalysts are preferably added by 0.02 to 0.3 mol to one mol of phenol.

As a phenol used in the case that the binder resin is the phenol formaldehyde resin, although a compound having a phenolic hydroxyl, such as alkylphenol, such as phenol, m-cresol, p-tert-butyl phenol, o-propyl phenol, resorcinol, and bisphenol A; halogenation phenol in which some or all of a benzene nucleus or an alkyl group are substituted with a chlorine atom or a bromine atom, may be listed up, especially phenol is desirable because high particle shape ability can be obtained.

As an aldehyde used in the case that the binder resin is the phenol formaldehyde resin, although a formaldehyde and a furfural in a state of one of formalin or paraformaldehyde may be listed, formaldehyde is desirable.

In the present invention, the specific phenol resin dispersion type carrier may be made a coated carrier in which the surface of carrier particles is coated with a coat resin which is chosen appropriately in accordance with a charge amount of a toner from a viewpoint to acquire an optimum charging characteristic, an optimum charging amount, and a high durability.

In the case that carrier particles are coated with a coat resin, it is desirable that the coat resin is coated to become in a range of from 0.1 to 10 weight %, more preferably from 0.3 to 5 weight % for carrier particles to be a core particle.

Further, in the coating with a coat resin, it is necessary to adjust a coating amount and a coating condition so as to make shape coefficients SF-1 and SF-2 of the obtained carrier to become predetermined values.

[Coat Resin]

A thermoplastic or thermally curable insulating resin is suitably used as the coating resin. Concrete examples of the thermoplastic insulating resin include an acryl resin such as polystyrene, a copolymer of poly(methyl methacrylate) and a styrene-acrylic acid, a styrene-butadiene copolymer, vinyl chloride, vinyl acetate, poly(vinylidene fluoride) resin, fluorocarbon resin, perfluorocarbon resin, solvent-soluble perfluorocarbon resin, poly(vinyl alcohol), poly(vinyl acetal), polyvinylpyrrolidone, a petroleum resin, a cellulose derivative such as cellulose, cellulose acetate, cellulose nitrate, methyl cellulose, hydroxymethyl cellulose and hydroxypropyl cellulose, a novolac resin, low molecular weight polyethylene, an aromatic polyester resin such as a saturated alkyl polyester resin, poly(ethylene phthalate), poly(butylene phthalate) and polyallylate, polyamide resin, polyacetal resin, polysulfone resin, polyphenylene suofide resin and poly(ether ketone) resin.

Examples of the thermally curable insulating resin include phenol resin, a modified phenol resin, a maleic resin, an alkyd resin, an epoxy resin and an acryl resin, in concrete, an unsaturated polyester formed by condensate polymerization of maleic anhydride-terephthalic acid-polyvalent alcohol, urea resin, melamine resin, xylene resin, toluene resin, guanamine resin, melamine-guanidine resin, acetoguanamine resin, glyptal resin, furan resin, silicone resin, polyimide, polyamidoimide resin, polyetherimide resin and polyurethane resin.

These coating resins may be used singly or in combination of two or more kinds of them. Moreover, it is allowed that a curing agent is mixed in the thermoplastic insulating resin for curing the coated resin.

As a method of coating of these coat resins on specific resin dispersion type carrier particles as a core particle, there may be a method of dissolving or dispersing a coat resin in an organic solvent so as to prepare a coat solution and coating the coat solution on carrier particles, and a method of merely mixing a coat resin shaped in powder like with carrier parcels so as to adhere the coat resin on the carrier particles may be employed.

The specific phenol resin dispersion type carrier preferably has a specific having a shape coefficient SF-1 of from 1.0 to 1.2, a shape coefficient SF-2 of from 1.1 to 2.5 and a volume-based median size of 10 to 100 μm.

Here, the shape coefficient SF-1 is an index which shows the degree of sphericity of carrier particles, and in the case of a true ball, SF-1 is set to 1. Further, the shape coefficient SF-2 is an index which shows the grade of fine convexoconcave of the surface of carrier particles, and when the surface is a smooth surface without convexoconcave, SF-2 is set to 1.

[Shape Coefficient of Carrier]

The shape coefficient SF-1 and SF-2 of carrier particles can be measured such that 100 macro-photographs are taken for carrier particles at random by use of a field emission scanning electron microscope "S-4500" manufactured by Hitachi, Co. Ltd., and the 100 macro-photographs are analyzed by use of an image processing analyzing apparatus "Luzex3" manufactured by Nicolet Co. Ltd., and the mean value is calculated based on the shape coefficient obtained by the following formulas (SF-1) and (SF-2).

$$SF\text{-}1=\{(MXLNG)^2/(AREA)\}\times(\pi/4) \qquad \text{Formula (SF-1)}$$

$$SF\text{-}2=\{(PERI)^2/(AREA)\}\times(1/4\pi) \qquad \text{Formula (SF-2)}$$

Here, in the above formulas (SF-1) and (SF-2), MXLNG represents the maximum diameter of carrier particles, AREA represents the projection area of carrier particles, and PERI represents the circumference length of carrier particles, respectively.

In this regard, the maximum diameter means the width of the carrier particles when a projection image of a carrier particle on a plane is pinched between two parallel lines and the distance between the parallel lines becomes the maximum. Also, the projection area means a area of an projection image of a carrier particle when the carrier particle is projected on a plane.

[Particle Size of Carrier]

The specified resin dispersion type carrier constituting the double-component of the invention has a volume based median diameter of from 10 to 100 μm, and preferably from 15 to 80 μm. The volume based median diameter of the specified resin dispersion type carrier can be typically measured by a laser diffraction type particle size distribution measuring apparatus HEROS, manufactured by Sympatec Co., Ltd., having a wet type dispersing device.

When the volume based median diameter of the specified resin dispersion type carrier is less than 10 μm, the ratio of fine particles in the distribution of carrier particles and easily image wise adheres to the photoreceptor because the magnetic force per particle is lowered. When the volume based median diameter of the specified resin dispersion type carrier exceeds 100 μm, scattering of the toner is caused because the specific surface area of the carrier particle is reduced and the toner holding force is lowered. Further, in a full color image having many solid portions, the reproducibility of the solid portions is not good.

The magnetization strength of the specified resin dispersion type carrier is preferably within the range of from 20 to 300 emu/cm$^3$ in a magnetic field of 1 kOe.

With regard to the mixing ration of toner and carrier in the two-component developer used in the two-sided image forming method of the present invention, the toner concentration in the two-component developer is 2 to 15% by weight, preferably 4 to 13% by weight.

According to the above-described both-sided image forming method, even when the carrier used in the structure in which, on both-sides of the recording sheet, the print is conducted by the thermal fixing, is a carrier using the phenol-formaldehyde resin, because the thermal fixing processing is conducted in the specific thermal fixing condition, the temperature rise in the device can be suppressed, accordingly, variation of water contained amount in the carrier is suppressed, hereby, the variation of the electric charging property is also suppressed, as the result, the sufficient image density can be obtained in the obtained visual image, and the toner scattering does not generate, as the result, stably good visual image can be formed.

Further, because the thermal fixing processing is conducted in the specific heating condition, the vaporization of the monomer component of the phenol-formaldehyde resin inevitably included in the carrier is suppressed, and the variation of the electric charging property of the toner is securely suppressed.

As described above, the present invention is described, however, the present invention is not limited to this, various changes can be added.

For example, as the fixing device used in the both-sided image forming method of the present invention, when it is the heating fixing system one, it is not limited to the above-described device, as the heating system, for example, IH heating system, as the fixing system, the system, for example, the belt fixing system, free nip belt fixing system, thin-walled fixing system can also be listed.

Further, for example, the both-sided image forming method of the present invention is not limited to the formation of monochromatic image as described above, can also apply to the formation of the color image. In this case, any structure of 4 cycle system both-sided image forming device structured by 4 kinds of color developing units according to each of yellow, magenta, cyan, black and one electrostatic latent image carrier, or the tandem system both-sided image forming device in which the color developing units according to each color and the image forming unit having the electrostatic latent image carrier are respectively mounted for color, may also be allowable.

EXAMPLES

Examples carried out for confirming the effects of the invention are described below, but the invention is not limited to the examples.

Carrier Producing Example 1

To each of magnetite ($FeO.Fe_2O_3$) powder having a number average primary particle diameter of 0.24 μm and $\alpha$-$Fe_2O_3$ powder having a number average primary average diameter of 0.60 μm, 5.5% by weight of a silane coupling agent (3-(2-aminoethylaminopropyl)dimethoxysilane) was added, respectively, and rapidly stirred at 100° C. in a stirring vessel for oleophilizing the each of the metal oxide fine particles to prepare oleophilic magnetite powder A and oleophilic $\alpha$-iron oxide powder A.

Composition (1) composed of 60 parts by weight of the oleophilic magnetite powder A, 40 parts by weight of oleophilic $\alpha$-iron oxide powder A, 10 parts by weight of phenol and 6 parts by weight of a formaldehyde solution containing 40% by weight of formaldehyde, 10% by weight of methanol and 50% of water was added to a flask containing an aqueous medium containing 28% by weight of $NH_4OH$ aqueous solution and heated by 85° C. spending for 40 minutes while stirring and subjected to thermally curing reaction for 3 hours while maintaining at this temperature and then cooled by 30° C. Water was further added and the supernatant was removed and remaining precipitate was washed by water, dried by air and further dried under reduced pressure of not more than 5 mmHg at 60° C. to obtain Carrier Particle [a].

A toluene coating solution containing 10% by weight of silicone resin was prepared and the coating solution was coated on Carrier Particles [a] as the core by evaporating the solvent while continuously applying shearing stress to the coating solution so that the coated amount of the resin was 1.0% by weight. After that, the coated layer was cured for 1 hour at 200° C. and loosed, and then classified by a sieve of 200 meshes to obtain specified phenol resin dispersion type Carrier [A] coated with silicone resin on the surface thereof.

The specified phenol resin dispersion type Carrier [A] had a volume based median diameter of 34 μm, a shape coefficient SF-1 of 1.04 and a shape coefficient SF-2 of 1.51. The strength of magnetization at 1 kOe was 129 emu/$cm^3$. The volume based median diameter was measured by the laser diffraction type particle size distribution measuring apparatus HEROS, manufactured by Sympatec Co., Ltd., having a wet type dispersing device, and the shape coefficients SF-1 and SF-2 were determined by randomly taking magnified photograph of 100 particles of the carrier by a field emission scanning electron microscope S-4500, manufactured by Hitachi Seisakusho Co., Ltd., and analyzing the photograph by an image processing analyzing apparatus Luzex 3, manufactured by Nicole Co., Ltd., and then calculating the average values derived from the following Expressions (SF-1) and (SF-2). The strength of magnetization was measured by a vibration magnetic field type automatic magnetic property recording apparatus BHV-30, manufactured by Riken Denshi Co., Ltd.

Carrier Production Example 2

Carrier Particle [b] was obtained in the same manner as in Carrier Producing Example 1 except that Composition (2) composed of 100 parts by weight of oleophilic magnetite powder A, 10 parts by weight of phenol and 6 parts by weight of a formaldehyde solution composed of 40% by weight of formaldehyde, 10% by weight of methanol and 50% of water was used in place of Composition (1). The specified resin dispersion type Carrier [B] was prepared in the same manner as in Carrier Producing Example 1 except that the amount of the coated resin is varied to 1.5% by weight. The specified resin dispersion type Carrier [B] had a volume based median diameter of 39 μm, a shape coefficient SF-1 of 1.10 and a shape coefficient SF-2 of 1.15. The strength of magnetization at 1 kOe was 218 emu/$cm^3$.

Carrier Production Example 3

Carrier particle [c] was obtained in the same manner as in Carrier Producing Example 2 except that oleophilic magnetite [B] was used as the oleophilic magnetite powder, which is obtained by adding 4.5% by weight of the silane coupling agent (3-(2-aminoethylaminopropyl)dimethoxsilane) to oleophilic magnetite powder and rapidly stirred and mixing at 100° C. in the mixing vessel for providing oleophilicity to the magnetite powder. The specified resin dispersion type Carrier [C] was obtained by using the carrier particle [c] in the same manner as in Carrier Production Example 1. The specified resin dispersion type Carrier [C] had a volume based median diameter of 41 μm, a shape coefficient SF-1 of 1.04 and a shape coefficient SF-2 of 1.95. The strength of magnetization at 1 kOe was 220 emu/$cm^3$.

Comparative Carrier Production Example 1

Comparative Carrier [E] composed of silicone resin coated Li-ferrite particle prepared by a sintering method which had a shape coefficient SF-1 of 1.3 and a shape coefficient SF-2 of 2.52 was prepared. The volume based median diameter of this carrier was 45 μm.

Comparative Carrier Production Example 2

To 100 parts by weight of polyester resin having a softening point of 150° C., 900 parts by weight of magnetite powder having a number average primary particle diameter of 0.24 μm was added, and melted and kneaded by a biaxial extruder. Then the resultant matter was crushed by a mechanical crushing machine. Thus crushed powder having a volume based median diameter of 38 μm was obtained. The shape of crushed powder was made to sphere by heating at 180° C. for 5 seconds by an instantaneous heat treating apparatus and the resultant particles were coated by the silicone resin in the same manner as in Carrier Production Example 1 to prepare Comparative Carrier [F].

The specified resin dispersion type Carrier [F] had a volume based median diameter of 39 μm, a shape coefficient SF-1 of 1.02 and a shape coefficient SF-2 of 1.04. The strength of magnetization at 1 kOe was 218 emu/cm$^3$.

Toner Production Example Bk1

Into a 2 L four-mouth flask provided with the high speed mixing apparatus TK type Homomixer, manufactured by Tokushu Kika Kogyo Co., Ltd., and a baffle plate, 600 parts by weight of deionized water and 500 parts by weight of a 0.1 mols/L $Na_3PO_4$, aqueous solution were charged and heated by 65° C. and then 70 parts by weight of a 1.0 mol/L aqueous solution of $CaCl_2$ was gradually added while stirring at 12,000 rpm to prepare an aqueous medium containing extremely fine particle of sparingly soluble dispersion stabilizer of $Ca_3(PO_4)_2$.

On the other hand, 78 parts by weight of styrene, 22 parts by weight of 2-ethylhexyl acrylate, 7 parts by weight of carbon black, 9 parts by weight of Parting Agent 2 and 1 part by weight of Parting Agent 6 were mixed and dispersion treated for 3 hours by an ATTRITER, manufactured by Mitsui Kinzoku Co., Ltd., and then 8 parts by weight of 2,2'-azobis (2,4-dimethyl-varelonitrile) was added to prepare a toner forming polymerizable monomer composition.

The toner forming polymerizable monomer composition was added to the above aqueous medium and stirred at 12,000 rpm by the high speed stirring machine for 15 minutes under nitrogen atmosphere at a interior temperature of 65° C. to form toner particles. After that the stirring machine was replaced by a propeller wing stirrer, and the above resultant suspension was maintained at the same temperature for 7 hours to continue the polymerization process while controlling the particle shape by the rotating rate of the stirrer wing and the angle of the baffle plate to complete the polymerization treatment. Further, 2 parts by weight of methyl methacrylate (Tg=100° C.) was dropped slowly in the suspension, and the suspension was allowed to react further for 4 hours, thereby preparing particles having a shell layer including methyl methacrylate on a core particle of a styrene-2-ethyl hexylacrylate. After that, the suspension was cooled and diluted hydrochloric acid was added for removing the dispersion stabilizer, and then the suspended particles were separated and repeatedly washed and dried to obtain Toner Particle (Bk-1).

Toner Particle (Bk-1) had a volume based median diameter of 6.5 μm, a peak molecular weight of 14,000, a molecular weight distribution ((Mw/Mn) of 8, a glass transition point temperature (Tg) of 45° C. and a softening point of 97° C.

The volume based median diameter was determined according to the particle size distribution within the range of from 2.0 to 40 μm measured by Coulter Multisizer, manufactured by Coulter Co., Ltd., using an aperture of 50 μm. The peak molecular weight and the molecular weight distribution were measured by gel permeation chromatography, and the softening point was measured by a Koka type flow tester.

Black Toner (Bk-1) was obtained by dry state mixing 100 parts by weight of Toner Particle (Bk-1) and 1.5 parts by weight of silica fine powder having a BET specific area of 140 m$^2$/g and treated by silicone oil using a HENSCHEL MIXER.

The shape and particle diameter of Toner Particle (Bk-1) were not varied by the addition of the silica fine particles.

Production Example of Toners Y1 to C1

A yellow toner Y1, magenta toner M1 and cyan toner C1 were each produced in the same manner as in the toner producing example Bk-1 except that the carbon black was replaced by C. I. Pigment Yellow 74, C. I. Pigment Red 122 and I. C. Pigment Blue 15:3, respectively.

Production Examples of Two-Component Developers Bk1 to C65

Two-component developers Bk1 to were prepared by combining Toners Bk1 to C1, and Carriers A to E, as shown in Table 1 and by mixing them so that the toner concentration was made to 6%.

TABLE 1

| Developer No. | | Carrier No. | Toner No. |
|---|---|---|---|
| Inventive | Bk1 | A | Bk1 |
| | Y1 | A | Y1 |
| | M1 | A | M1 |
| | C1 | A | C1 |
| | Bk2 | B | Bk1 |
| | Y2 | B | Y1 |
| | M2 | B | M1 |
| | C2 | B | C1 |
| | Bk3 | C | Bk1 |
| | Y3 | C | Y1 |
| | M3 | C | M1 |
| | C3 | C | C1 |
| Comparative | Bk4 | D (Comp.) | Bk1 |
| | Y4 | D (Comp.) | Y1 |
| | M4 | D (Comp.) | M1 |
| | C4 | D (Comp.) | C1 |
| | Bk5 | E (Comp.) | Bk1 |
| | Y5 | E (Comp.) | Y1 |
| | M5 | E (Comp.) | M1 |
| | C5 | E (Comp.) | C1 |

Examples 1 to 3 and Comparative Examples 1 to 2

Practical copying test was carried out in which a composite image divided into a full color image having a pixel ratio of each color of 5% and a solid black image was printed 50,000 sheets in an one by one intermittent mode under a high temperature and high humidity condition (32° C. and 85% RH) using each of the above obtained two-component developers Bk1 to C5 in the combination shown in Table 2 by a digital copying machine bizhub Pro C350, manufactured by Konica Minolta Co., Ltd. The absolute reflective densities of 15 optional points on the solid black portions of the first and 50,000$^{th}$ prints were measured by a reflective densitometer RD-918, manufactured by Macbeth Co., Ltd., and the solid black image density unevenness was evaluated by the difference the maximum value and the minimum value among the 15 measured values. Moreover, for the full color image portions of the first and 50,000$^{th}$ prints, the fog density was measured as described below, the results are shown in Table 2.

[Fixing Device]

The fixing device is the fixing device of the contact heating system as shown in FIG. 2, and its specific structure is as follows. The heating roller [31] in which the surface of the core metal [31*b*](inner diameter 30 mm, wall thickness 0.6 mm, total width 310 mm) is covered by the sheathing layer [31*c*] formed of PFA tube in 50 μm thick, and the heater [31*a*] is housed in the central part, and the pressure roller [32] in which the surface of the core metal [32*a*] (inner diameter 30 mm, wall thickness 1.0 mm) is covered by the sheathing layer [32*b*] formed of the sponge-like silicon rubber (Asker C hardness 48°, thickness 2 mm) are brought into contact by the total load 150 N and the fixing nip part N of 3.6 mm width is formed.

Then, it is used under the condition that the fixing temperature of this fixing device [30] is controlled to 120° C., and the surface temperature of the recording sheet P in the delivery port from the fixing device [30] is adjusted to 97° C., and the line speed of the print is set to 160 mm/sec.

[Evaluation of Fog Density]

The absolute reflective densities of 20 optional points on a non-printed white paper were measured by a reflective densitometer RD-918, manufactured by Macbeth Co., Ltd., and the average density of the measurements was made as a white paper density. Subsequently, for white portions of images to be measured a fog density, similarly the absolute reflective densities of 20 optional points were measured and averaged and a difference obtained by subtracting the white paper density from the averaged value was evaluated as a fog density. If the fog density is 0.005 or less, it is not problem for practical use.

Comparative 3

A practical copying test was carried out in the same manner with Example 1 except that the fixing temperature of the fixing device (30) was controlled to be 150° C. and the surface temperature of a recording sheet at the exit from the fixing device (30) was controlled to be 128° C., and the solid black image density unevenness was evaluated and the fog density was measure. The results are shown in Table 2.

TABLE 2

| | Combination of two component developer | Surface temperature of a recording sheet | Solid black image density | | Fog density | |
|---|---|---|---|---|---|---|
| | | | The first | 50,000$^{th}$ prints | The first | 50,000$^{th}$ prints |
| Inv. Ex. 1 | Bk1/Y1/M1/C1 | 97° C. | 1.41 | 1.41 | 0 | 0.001 |
| Inv. Ex. 2 | Bk2/Y2/M2/C2 | 97° C. | 1.42 | 1.41 | 0 | 0.001 |
| Inv. Ex. 3 | Bk3/Y3/M3/C3 | 97° C. | 1.42 | 1.41 | 0 | 0.001 |
| Com. Ex. 1 | Bk4/Y4/M4/C4 | 97° C. | 1.41 | 1.34 | 0 | 0.006 |
| Com. Ex. 2 | Bk5/Y5/M5/C5 | 97° C. | 1.42 | 1.36 | 0 | 0.009 |
| Com. Ex. 3 | Bk1/Y1/M1/C1 | 128° C. | 1.42 | 1.29 | 0 | 0.018 |

As noted from Table 2; in Examples 1 to 3 according to the both-sided image forming method of the present invention, it was confirmed that a sufficient image density could be obtained in an image even after the image formation of 50,000 sheets and the occurrence of fog could be refrained.

What is claimed is:

1. An image forming method of forming images on both sides of a recording sheet; comprising the steps of:

(1) forming a first electrostatic latent image on an image carrying member, developing the first electrostatic latent image with a two-component developer so as to form a first toner image on the image carrying member, transferring the first toner image from the image carrying member to a first surface of a recording sheet at a transfer section, and fixing the first toner image on the first surface of the recording sheet with heat at a fixing section;

(2) returning the recording sheet bearing the fixed toner image on the first surface from the fixing section to the transfer section without stacking the recording sheet in a tray between the fixing section and the transfer section;

(3) forming a second electrostatic latent image on the image carrying member, developing the second electrostatic latent image with the two-component developer so as to form a second toner image on the image carrying member, transferring the second toner image from the image carrying member to a second surface of the recording sheet at the transfer section, and fixing the second toner image on the second surface of the recording sheet with heat at the fixing section;

wherein the two-component developer includes toner particles each containing a binder resin having a glass transition temperature Tg° C. and a colorant and carrier particles in each of which magnetic powder is dispersed in a binder resin including a phenol formaldehyde obtained by a polymerization process, and the first toner image is fixed with the heat in such a way that the surface temperature of the first surface of the recording sheet is made to a temperature in a range from the Tg° C. or more and lower than 100° C. after the first toner image has been fixed on the first surface of the recording sheet with heat.

2. The image forming method of claim 1, wherein the recording sheet bearing the fixed toner image on the first surface is returned from the fixing section to the transfer section without being stacked in a tray between the fixing section and the transfer section.

3. The image forming method of claim 2, wherein the glass transition temperature Tg° C. of the binder resin of the toner is from 50 to 75° C.

4. The image forming method of claim 1, wherein the surface temperature of the first surface of the recording sheet is a temperature in a range of Tg+20° C. and 70° C.

5. The image forming method of claim 1, wherein the toner is a capsule type toner in which internal additives including coloring fine particles are contained in the binder resin.

6. The image forming method of claim 1, wherein the fixing section includes a heating member and the surface temperature of the heating member is a temperature in a range of 100° C. and lower than 150° C.

7. The image forming method of claim 1, wherein the two-component developer is accommodated in a container having an inside temperature less than 100° C. during the image forming method is performed.

8. The image forming method of claim 1, wherein the glass transition point temperature (Tg) of the binder resin is in a range of 50 and 75° C.

9. The image forming method of claim 1, wherein the binder resin comprises a value of the ratio (Mw/Mn) of the weight average molecular weight (Mw) and the number average molecular weight (Mn) is 2-100.

10. The image forming method of claim 1, wherein the magnetic powder comprises at least one of materials including iron, a ferrite and a magnetite.

11. The image forming method of claim 1, wherein content of the magnetic powder in the carrier is 40 to 99 weight %.

12. The image forming method of claim 1, wherein the magnetic powder has a number average primary size of 0.1 to 0.5 μm.

13. The image forming method of claim 1, wherein the toner concentration in the two-component developer is 2 to 15% by weight.

14. The image forming method of claim 13, wherein the surface temperature of the first surface of the recording sheet is a temperature in a range of Tg+20° C. and 70° C.; the glass transition temperature Tg° C. of the binder resin of the toner is from 50 to 75° C.;

the binder resin comprises a value of the ratio (Mw/Mn) of the weight average molecular weight (Mw) and the number average molecular weight (Mn) is 2-100;

content of the magnetic powder in the carrier is 40 to 99 weight %; and the magnetic powder has a number average primary size of 0.1 to 0.5 μm.

15. The image forming method of claim 1, wherein the binder resin is derived from at least a monomer having at least one of a carboxyl group, a sulfonic acid group and a phosphoric group.

* * * * *